United States Patent [19]

Sutton

[11] 4,273,064

[45] Jun. 16, 1981

[54] HATCH COVER

[76] Inventor: Robert W. Sutton, P.O. Box 774, Port Orford, Oreg. 97465

[21] Appl. No.: 8,326

[22] Filed: Feb. 1, 1979

[51] Int. Cl.[3] ..... B63B 19/14

[52] U.S. Cl. ..... 114/203; 292/6

[58] Field of Search ..... 114/201 R, 203, 116, 114/117, 335, 320; 244/129.4, 129.5; 105/377; 292/6, 256.5; 49/317, 463, 464; 220/314, 316, 206, 208

[56] References Cited

U.S. PATENT DOCUMENTS

| | | | |
|---|---|---|---|
| 1,508,817 | 9/1924 | Pfaehler et al. | 220/206 |
| 1,858,013 | 5/1932 | Heins | 220/316 |
| 3,374,805 | 3/1968 | Trevarrow, Jr. | 220/206 |
| 4,020,778 | 5/1977 | Sutton | 292/6 |

*Primary Examiner*—Trygve M. Blix
*Assistant Examiner*—Jesús D. Sotelo
*Attorney, Agent, or Firm*—Klarquist, Sparkman, Campbell, Leigh, Hall & Whinston

[57] ABSTRACT

A hatch cover for closing and sealing a hatch opening has a latching mechanism at one side of the cover which includes a rotatable hub and plural latching arms extending in different directions from the hub towards a rim of the opening. Rotation of the hub in one direction causes the latching arms to engage the rim and tightly latch the cover to the rim while rotation of the hub in the opposite direction retracts the latching arms and frees them from the rim to enable removal of the cover from the opening. A shaft extends through the cover and is axially slidable and rotatable relative to it. The shaft is axially slidable relative to the hub and continuously engages it so that rotation of the shaft correspondingly rotates the hub. A handle fixed to the upper end of the shaft rotates the hub to activate the arms. When the cover is latched tightly to the rim, axial sliding of the shaft in one direction moves the handle into an aligned recess in the top surface of the cover so latched and unlatched conditions of the cover can be determined by visually inspecting the position of the handle. A seal surrounding the shaft between the shaft and cover prevents leakage of fluid therebetween when the handle is in the recess. The shaft defines a venting passageway which automatically bypasses the seal when the handle is withdrawn from the recess.

19 Claims, 6 Drawing Figures

HATCH COVER

BACKGROUND OF THE INVENTION

1. Field of the Invention

The present invention relates to a hatch cover and especially to a hatch cover for effectively closing and fluid sealing a hatch opening in a ship and analagous vessels.

2. Description of the Prior Art

The present invention is an improvement of my prior art hatch cover disclosed in U.S. Pat. No. 4,020,778 issued May 3, 1977.

As noted in the aforementioned patent, my previously patented hatch cover overcomes many of the drawbacks of other prior art hatch covers by providing a hatch cover with the capability of forming a water-tight seal after repeated closures, which is free of jamming and other malfunctions despite long exposure to salt water, which is mechanically simple and not dependent upon close tolerances between unnecessarily complex and numerous moving parts, and which eliminates the problem of lost or misplaced latch-actuating handles.

However, in my prior art hatch cover it is extremely difficult, if not impossible, to determine from visual inspection whether or not the hatch cover is securely fastened in place. Instead, time consuming checking and, in many cases, actual manipulation of the latching mechanism is required before it can be verified that the cover is latched. These difficulties associated with determining latched and unlatched conditions of a hatch cover are also common with other prior art hatch covers as well.

In addition, pressure can build up on one side of hatch covers used to seal cargo holds of barges and like vessels. When hatch covers used in these applications are opened, these pressure buildups are suddenly released and can move the covers abruptly, much to the surprise of the operator.

In view of the foregoing, there is a need for an improved hatch cover in which the latched condition thereof can quickly and easily be determined from visual inspection from a remote location. Furthermore, there is a need for such a hatch cover which eliminates the problems caused by a sudden pressure release, when opened, while at the same time providing a water-tight seal of the hatch opening when closed.

SUMMARY OF THE INVENTION

It is a primary object of the invention to provide a hatch cover with an improved latching mechanism.

It is another object of the invention to provide such a hatch cover which allows a remote visual determination of whether or not it is latched.

It is a further object of the invention to provide a hatch cover which can be determined to be latched without the need for manipulation of the latching mechanism.

It is another object of the invention to provide an improved latching mechanism which is quickly operable for sealing and releasing the hatch cover.

Still another object of the invention is to provide an improved hatch cover particularly adapted for barges and other vessels in which pressure buildup within a hold on one side of the cover is a problem.

A further object of the invention is to provide an improved hatch cover which automatically vents a pressure differential across the hatch cover prior to release of the hatch cover from the surrounding hatch opening.

The foregoing and other objects, features and advantages of the present invention will become more apparent from the following detailed description which proceeds with reference to the accompanying drawings.

DESCRIPTION OF PREFERRED EMBODIMENT

Figure 1:
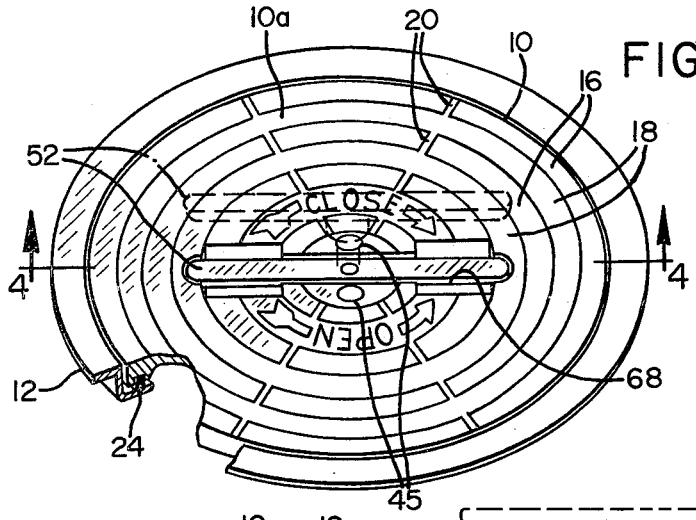
FIG. 1 is a perspective view of the top of a hatch cover assembly in accordance with the invention with an edge portion of the assembly broken away to reveal the sealing interrelationship between the hatch cover and surrounding rim of the hatch opening.

Referring first to FIGS. 1–4, a circular plate-like cast metal hatch cover 10 closes a hatch opening defined by a circular metal rim or ring 12. Rim 12 of the hatch opening preferably forms a part of the hatch assembly with the hatch cover, to be affixed as by welding to the deck 14 of a ship or other vessel at the time of installation of the hatch cover to ensure a proper fit. In cross section, rim 12 is an angular member which includes a top flange **12*a* adapted to overlap and join deck 14. Top flange 12*a* is joined by a web portion 12*b* to a bottom flange 12*c* which forms a seat for supporting hatch cover 10**.

Hatch cover 10 has a top side **10*a* and a bottom side 10*b*. The top side has a series of concentric, alternating annular lands 16 and shallow grooves 18 and radial grooves 20** which define together a nonskid top surface that drains water from the lands into the grooves to provide a firm footing when the deck is wet.

Bottom surface **10*b* has a series of integral radial reinforcing ribs 22 for rigidity under load. Bottom surface 10*b* also has an annular groove near its outer perimeter which receives sealing means in the form of a resilient elastomeric sealing ring 24 which forms a fluid-tight seal with seat flange 12*c* of rim 12 when the hatch cover is seated and clamped against the rim. As shown best in FIGS. 4 and 7, sealing ring 24 has double lip portions 24*a*** which tend to spread into tight sealing engagement with the rim and enhance its sealing effectiveness when the cover is clamped to the rim.

Three latching or locking arms 26 are symmetrically arranged about the bottom of the hatch cover and radiate from a central portion of the hatch cover and terminate near its outer periphery. The inner ends of the latching arms are connected to a rotatable arm-actuating latching hub 28 by universal connecting means comprising ball-and-socket type connections 30. The radially inner ends of the arms form the ball portions of the connections, and the hub forms the socket portions. Together the three latching arms and hub define part of a latching means or assembly for latching and sealing the cover tightly to rim 12.

Figure 4:
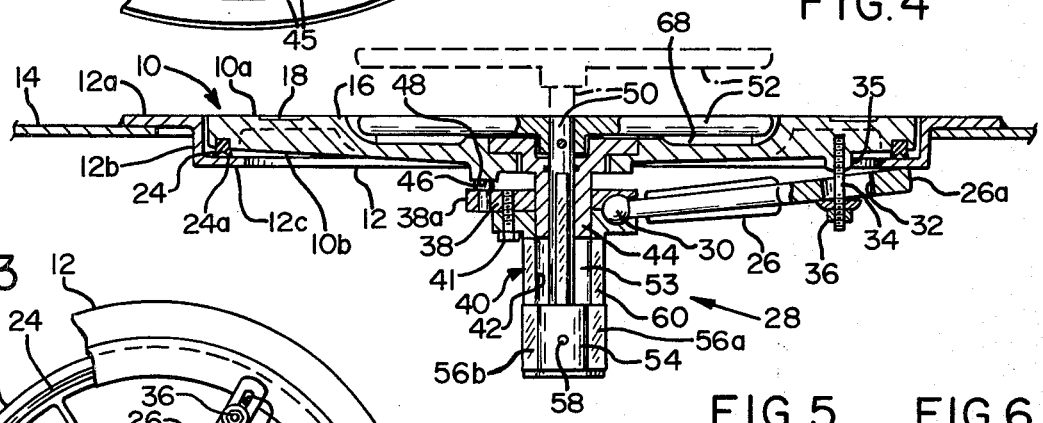
FIG. 4 is a sectional view of the assembly taken approximately along the line 4—4 of FIG. 1, with the handle of the hatch cover shown in its raised position by dashed lines.
Figure 3:
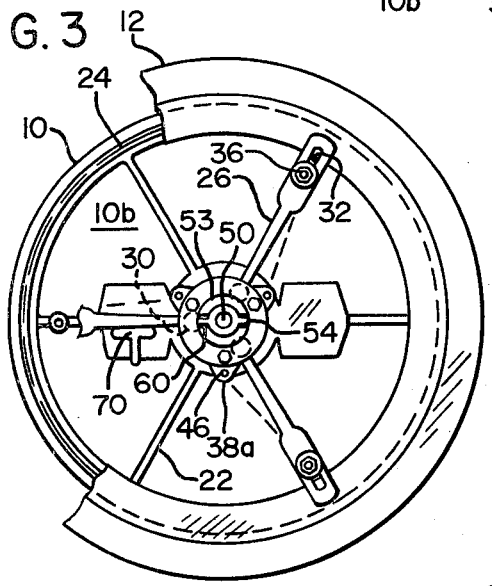
FIG. 3 is a bottom plan view of the hatch cover assembly of FIGS. 1 and 2 with a portion of the rim broken away.
Figure 2:
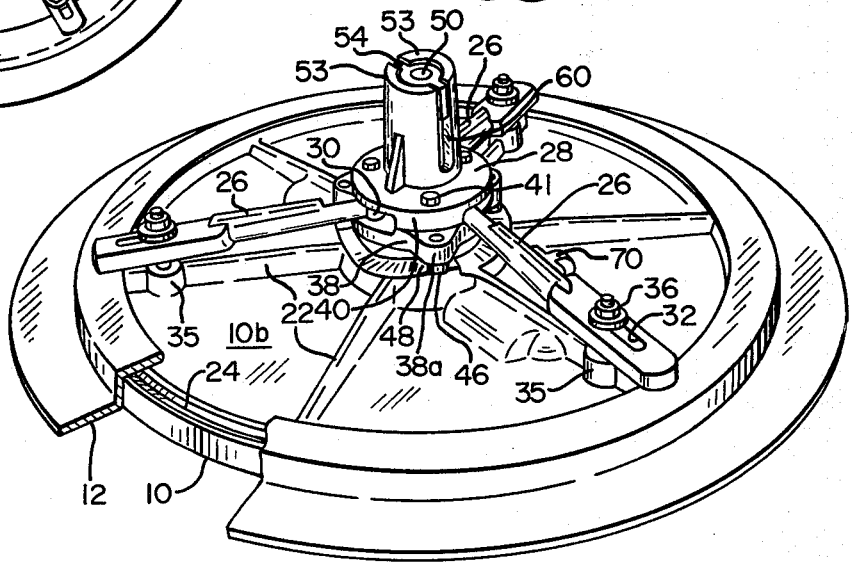
FIG. 2 is a perspective view of the bottom of the hatch cover assembly of FIG. 1 on an enlarged scale with a portion of the rim of the hatch opening broken away.

The three latching arms are connected loosely to the bottom of cover 10 between their opposite ends by additional universal type connecting or retention means. Such means for each arm includes an elongated slot 32 extending through the arm near its outer end and a retaining screw or stud 34 extending through the slot and threaded at one end into an enlarged portion 35 of one of the reinforcing ribs 22 of the cover as shown in FIGS. 2 and 4. The outer end of screw 34 outwardly of the arm has an enlarged head portion 36 covering slot 32 formed by a washer and nut assembly. Such connecting means enables each arm to move to a limited extent both longitudinally and pivotally about axes both perpendicular and parallel to the plane of the cover.

Latching arms 26 are of a length such that when they are in true radial positions with respect to the axis of rotation of the hub, they overlap the bottom flange of rim 12 to prevent removal of the hatch cover from the hatch opening. By rotating hub 28 to a limited extent through a limited arc, the inner ends of arms 26 are shifted from their true radial positions, withdrawing the arms inwardly from rim 12 as shown in dashed lines in FIG. 3. Such motion is permitted by the loose slotted connection between the arms 26 and the cover at retention screws 34 and permits removal of the hatch cover from the hatch opening.

Arm-actuating hub 28 is a two-piece assembly including an inner base member 38 and an outer collar member 40 joined together by screws 41. At their intersections they form the socket portions of the ball-and-socket connections 30 for each of the three arms 26. A central opening 42 extends through both base and collar of the hub. Opening 42 enables the hub assembly to be slidably and rotatably received on a retaining collar portion 44 of cover 10. Thus, hub 28 is both freely rotatable and freely slidable on retaining collar 44 within the limits permitted by the retention screw assembly 34 and the ball-and-socket connections. Retaining collar 44 is fastened to the remainder of cover 10 by screws 45, shown in FIG. 1.

The base 38 of hub 28 has three laterally projecting ears **38*a* with holes therethrough which receive cam bearings 46, preferably made of a hard, low-friction material such as nylon. The bottom surface 10*b* of the hatch cover is formed with raised central inclined cam surfaces 48 on which the cam bearings 46 of the hub ride. Inclined cam surfaces 48 are shaped, arranged, and positioned in a circular path such that as the hub rotates in a hatch-closing direction and as latching arms 26 overlap the rim and approach their fully extended positions, cam bearings 46 ride up inclined cam surfaces 48 of the cover, forcing the hub outwardly along collar 44 away from the cover. As the hub shifts outwardly, the connected inner ends of locking arms 26 also move outwardly away from the cover. This causes arms 26 to fulcrum about retention screws 34 and thereby force their outer ends 26*a* inwardly against the bottom flange of rim 12. As a result, outward reaction forces are applied at the fulcrum points against the heads of retention screws 34 and leverages the cover into tight seated and fluid-sealed engagement with rim 12**.

Of course, rotation of the hub in the opposite, hatch opening direction, has the opposite effect. With such rotation, cam bearings 46 first ride down the inclined plane of cam surfaces 48 and release outer ends **26*a*** of the locking arms from clamping engagement with the rim and then withdraw such arms from the rim to enable removal of the hatch cover.

Hub actuation or rotation means are provided for rotating hub 28 to activate the latching arms 26 and camming means. Such rotation means includes a shaft 50 which extends centrally through retaining collar 44 of the cover and through hub 28 and which projects at one end from the top surface of the cover. The shaft can normally rotate relative to the cover and slide axially relative to both the cover and hub. A simple straight handle 52 is affixed to the upper end of the shaft.

Coupling means are provided on a lower portion of the shaft below the cover for operating engagement with the hub. In the illustrated embodiment, such means comprise a sleeve member 54 having a central opening for receiving a lower portion of shaft 50. A pin 58 secures the sleeve member to the shaft. Sleeve member 54 includes vertical coupling wings or bar portions **56*a*, 56*b* projecting laterally from diametrically opposed sides thereof. An elongated lower surface portion 53 of outer collar 40 of the hub 28 has diametrically opposed slots 60, each of which receives one of the wing portions 56*a*, 56*b* so that rotation of handle 52 rotates shaft 50 to in turn rotate hub 28 and actuate latching arms 26**.

Hub surface 53 and its slots 60 are of sufficient length so that wing portions **56*a*, 56*b* are positioned continuously within the slots in all axial positions of shaft 50. Consequently, shaft 50 is in continuous loose engagement with hub 28** so that relative rotation between the shaft and hub does not occur. As a result, each angular or rotational position of the shaft about its axis corresponds to a particular rotational position of the hub.

In addition, an indicator means such as handle 52 provides a visual indication of the angular position of the shaft.

Also, a reference position indicator means affixed to said cover and observable from the side of the cover opposite the latching mechanism is provided. In the preferred embodiment, such reference position indication means comprises a recess-defining surface portion 68 in the upper surface of cover 10 explained below.

Thus, because relative rotation between hub 28 and shaft 50 is prevented, when the hub is in a latched position with arms 26 tightly gripping ring 12, shaft 50 is in a predetermined latched indicating angular position. This position of the hub corresponds to a particular position of handle 52 relative to the reference position indicator on the cover so that whenever the handle is observed to be in this latched indicating position, the cover is positively latched. Hence, latched and unlatched conditions of the cover to the rim can be visually determined. This is true regardless of the initial orientation of the cover within the hatch opening. Such observation can be accomplished from remote locations from which the hatch cover is visible, such as from the bridge of a ship.

Also, the hatch cover can be quickly opened and closed as wing portions **56*a*, 56*b* continuously engage slots 60 and need not be manipulated into alignment with these slots prior to rotating hub 28**.

Channel-defining surface portion 68 is shaped to receive and store handle 52 whenever the shaft is in an angular position such that axial downward sliding of the shaft places the handle into the recess. Recess 68 is of a depth such that the upper surface of the handle is flush with upper surface 10*a* of the hatch cover when the handle lies fully within the recess. In this way, the handle need not be disconnected from the shaft when not in use and will not be an obstruction to persons walking over the deck. The elongated recess 68 extends diametrically across the upper surface of the hatch cover and has enlarged rectangular well portions 64 near its opposite ends. The well portions extend laterally beyond and to a depth greater than the remainder of recess 68 so that the handle can be readily gripped and withdrawn from the recess of the cover to its raised operating position shown in dashed lines in FIGS. 1 and 4.

The recess-defining surface portion 68 is positioned on the cover so that the handle moves into alignment with the recess simultaneously as latching arms 26 approach their fully extended positions and securely latch cover 10 to rim 12. Thus, whenever handle 52 is aligned with the recess so that it can be axially slid into it, the cover is correspondingly latched. Therefore, whenever handle 52 is observed to be positioned within or aligned with the recess, the hatch cover is positively latched.

To help align the handle with the recess, a stop 70 is also cast into the bottom surface of the cover to determine the limits of rotation of the hub in a direction to latch the cover. This stop abuts one of arms 26 to limit rotation of the hub in the closing direction precisely when handle 52 is aligned with the recess and hence when the cover is latched in place. Without such stop, continued rotation of the hub in a "latching" or "closing" direction would shift the latching arms beyond their true radial positions to withdraw the arms from overlapping engagement with the rim.

If desired, and as shown clearly in FIG. 1, arrows and words indicating the directions of opening and closing of the cover can be cast into the surface of the cover.

Figure 5:
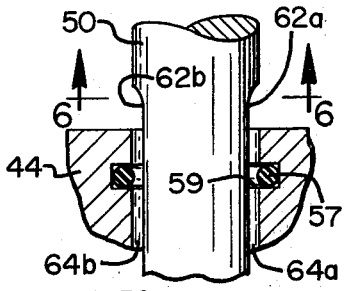
FIG. 5 is an elevational view, partially in section, of a portion of the shaft and hub retaining collar of the invention.
Figure 6:
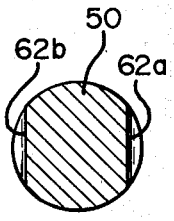
FIG. 6 is a cross-sectional view of the shaft of the invention taken along lines 6—6 of FIG. 5.

The central shaft passage of retaining collar 44 carries a sealing means such as O-ring seal 57 (FIG. 5) retained within an annular slot 59 near its upper end to prevent seepage of water through the passage between the collar and shaft.

The hatch cover also includes pressure relieving or venting means for venting a buildup of pressure at one side of the cover prior to arms 26 clearing rim 12. More specifically, in the preferred embodiment, such venting means cooperates with the shaft so that when the handle is withdrawn from the recess, a bypass passageway communicating from one side of the cover to the other bypasses the seal. In the illustrated form, this bypass passageway is defined by a vent defining surface portion of shaft 50 of reduced diameter and more specifically by elongated flats 62*a* and 62*b* along the vent defining portion of shaft 50. This vent-defining portion is positioned entirely below O-ring seal 57 when the handle is in the recess. Conversely, when the handle is raised out of the recess, surface portions 62*a* and 62*b* move upwardly to extend above and below the O-ring seal. As a consequence, respective bypass passageways 64*a*, 64*b* extend past O-ring seal 57 through gaps between surfaces 62*a*, 62*b* and the seal. Thus, venting of the hatch cover is coordinated with the rotation of the shaft. That is, recess 68 is sized so that its side defining portions prevent rotation of handle 52 and hence of shaft 50 and the opening of the cover when the handle is within the recess. On the other hand, when shaft 50 is moved axially outwardly so that handle 52 clears the recess where the shaft can be rotated, venting through the bypass passageway automatically occurs. Thus, venting occurs prior to rotation of the shaft. In the illustrated embodiment, handle 52 and shaft 50 thereby comprise one form of a control for controlling the flow of fluid through the venting passageway.

OPERATION

To insert the hatch cover over the hatch opening, the cover is grasped by its handle 52 with the handle in its raised position as shown in dashed lines in FIG. 4 and turned to a position in which the hub retracts arms 26. The cover is then carried over the hatch opening and lowered onto bottom flange 12*c* of rim 12. Handle 52 is thereupon rotated in a counter-clockwise direction, as viewed in FIG. 1, to rotate shaft 50 and cause wings 56*a*, 56*b* to rotate locking hub 28, thereby extending locking arms 26 until they overlap bottom flange 12*c* of rim 12. Near the end of such rotation, the hub is cammed outwardly away from the cover by camming surfaces 48. This pivots the locking arms 26 about their retention studs 34 to force the outer ends of the arms against the rim and leverage cover 10 tightly into sealed engagement with the rim, as shown in solid lines in FIG. 4. During the cover-latching operation, the handle is turned in the closed direction until it is aligned with recess 68 and the cover is in its fully latched and sealed condition.

With the cover sealed in place, handle 52 is pushed downwardly, sliding shaft 50 through the cover and hub until handle 52 is positioned within the recess.

To remove the cover from the hatch opening, handle 52 is lifted from cover recess 68. As wings 56*a* and 56*b* continuously engage slots 60, turning of handle 52 in a clockwise direction, as shown in FIG. 1, causes arms 26 to clear the bottom flange of rim 12, after which the cover can be lifted from the hatch opening by its handle 52. Th degree to which the handle 52 can be turned in its clockwise direction is limited by the ball-and-socket joints 30 joining the locking arms to the hub. Such joints permit the arms to be withdrawn only to a position in which the outer ends of the arms just clear the rim to prevent removal of the hatch cover.

Simultaneously with the lifting of handle 52 from recess 68, portions of surfaces 62*a* and 62*b* of shaft 50 are positioned on each side of O-ring 57. This vents any pressure buildup across the cover prior to unlatching arms 26 from the rim.

In the preferred embodiment shown, the camming surface means are provided on the cover for coacting with bearing surfaces of the hub to pivot the latching arms about the fulcrum and thereby transfer closing forces through the fulcrums to the cover. Alternatively, such closing forces can be transferred from such arms through their fulcrums to the cover by providing such camming surface means either on the rim of the hatch opening or on the outer ends of the arms to pivot the outer ends of the arms outwardly away from the cover and rim.

In addition, the hatch cover can be modified to take varying shapes, for example oblong rather than round, and may be hinged to the rim surrounding the opening. Of course, when hinged to the rim the rotational position of handle 52 can be references to a mark or other reference on the deck. Also, more than three latching arms can be provided as desired.

Having illustrated and described the principles of my invention with reference to a preferred embodiment, it should be apparent to those persons skilled in the art that such invention may be modified in arrangement and detail without departing from such principles.

I claim as my invention all such modifications as come within the true spirit and scope of the following claims.

1. A plate-like hatch cover for closing a hatch opening comprising:

a latching mechanism at one side of the cover including a rotatable hub and operable such that rotation of the hub in opposite directions through a limited arc respectively latches and unlatches the cover to and from a rim surrounding the opening;

a hub rotating member extending through said cover from said one side to the other side thereof, said hub rotating member being rotatable relative to said cover; and coupling means for operatively coupling said hub rotating member to said hub such that rotation of said hub rotating member rotates said hub to latch and unlatch the cover and such that said hub rotating member is in a predetermined angular position when said cover is latched so that angular positions of said hub rotating member relative to said cover indicate latched and unlatched conditions of said cover.

2. A hatch cover according to claim 1 in which said coupling means couples said hub rotating member to said hub that any substantial relative rotation between said hub rotating member and said hub is prevented.

3. A hatch cover according to claim 1 which includes movable indicator means on said hub rotating member at said other side of said cover and reference position indicator means on said other side of said cover for providing a visual indication of the angular position of said hub rotating member relative to said reference position indicator means and thereby of latched and unlatched conditions of said cover.

4. A hatch cover according to claim 3 in which said coupling means connects said hub rotating member to said hub in all axial positions of said hub rotating member.

5. A hatch cover according to claim 3 in which said hub rotating member includes a shaft extending centrally through said hub and said cover, said shaft being axially slidable and rotatable relative to said cover;

said movable indicator means comprising a rotatable handle for rotating said shaft, said handle being affixed to one end of said shaft on said other side of said cover;

said reference position indicator means comprising a handle receiving recess defining portion on said opposite side of said cover which defines a recess in the cover for storing said handle when not in use, said handle being movable into the recess by sliding said shaft axially through said cover and within said hub, said recess defining portion being sized such that the portions thereof defining the sides of the recess restrain said handle and thereby said shaft from rotating when said handle is in said recess.

6. A hatch cover according to claim 5 wherein said coupling means comprises means projecting laterally from said shaft for continuously engaging said hub at least when said handle is removed from said recess; and said latching mechanism is operable such that said cover is latched to the rim when said shaft is in an angular position in which axial sliding of said shaft in one direction moves said handle into the recess, whereby positioning of the handle within the recess provides a visual indication of the latched condition of said cover.

7. A hatch cover according to claim 5 including fluid sealing means between said shaft and a wall of the cover defining an opening through which the shaft passes so as to prevent leakage of fluid through said opening between opposite sides of said cover when said handle is positioned in said recess, said shaft and wall defining a bypass passageway positioned at said one side of said cover when said handle is in the recess and positioned to communicate around said fluid sealing means and through said cover when said handle is outside of the recess.

8. A hatch cover according to claim 7 in which said fluid sealing means comprises O-ring sealing means surrounding said shaft, said shaft including a portion of circular cross section in sealing engagement with said O-ring sealing means when said handle is in said recess;

said shaft including an axially elongated venting section comprising a recessed surface bypass passageway defining portion, said venting section being positioned entirely at said one side of said O-ring sealing means when said handle is in the recess, said venting section being positioned across said O-ring sealing means such that said recessed surface bypass passageway bypasses said O-ring sealing means to provide a pressure venting passage through said opening when said handle is outside the recess communicating from one side of the cover to the other side.

9. A hatch cover according to claim 1 including means for relieving a differential in pressure across the sides of the cover prior to unlatching the cover from the rim.

10. A hatch cover according to claim 1 in which said hub rotating means includes means for relieving a differential in pressure across the opposite sides of the cover.

11. An improved plate-like hatch cover for closing a hatch opening of the type having a latching mechanism at one side of the cover which includes a rotatable hub and plural latching arms extending in different directions from the hub towards a rim of the opening, said mechanism being operable such that rotation of said hub through a limited arc in one direction from a latched position, in which said latching arms engage the rim and tightly latch the cover to the rim, moves said latching arms out of latching engagement with the rim and frees them from the rim while rotation of said hub in the direction opposite said one direction moves said latching arms into latching engagement with the rim, wherein the improvement comprises:

a threadless hub rotating member axially slidable relative to said cover and rotatable relative to said cover at least when in certain axial positions, and coupling means for coupling said hub rotating member to said hub such that the angular position of said hub rotating member indicates when the hub is in the latched position.

12. A plate-like hatch cover according to claim 11 in which said coupling means comprises means for positively coupling said hub rotating member to said hub in all axial positions of said hub rotating member so as to prevent relative rotation between it and said hub.

13. A plate-like hatch cover according to claim 11 in which said hub rotating member includes a shaft extending centrally through said cover and at least partially through said hub and being axially slidable and rotatable relative to said cover, and an elongated handle for rotating said shaft;

said handle being affixed to one end of said shaft at the side of said cover opposite said one side, said opposite side of said cover having an elongated recessed channel defining portion for storing said handle when not in use, said handle being movable into the channel defining portion by sliding said shaft axially through said cover and hub only when said hub is in the latched position, said channel defining portion being sized so that the portions thereof defining the sides of the channel restrain said handle and thereby said shaft from rotating when said handle is in said channel; and said coupling means comprising means for continuously engaging said hub when said handle is out of said channel-defining portion so that the angular position of the handle relative to said recessed channel-defining portion provides a visual indication of the latched condition of said cover.

14. An improved plate-like hatch cover for closing a hatch opening of the type having a latching mechanism at one side of the cover, which includes a rotatable hub and plural latching arms extending in different directions from the hub towards a rim of the opening, said mechanism being operable such that rotation of said hub in one direction frees said latching arms from latching engagement with the rim while rotation of said hub in the opposite direction engages said latching arms with the rim, wherein the improvement comprises:

venting passageway defining means for defining a pressure relief passageway from one side of said cover to its opposite side;

control means for controlling the flow of fluids through said passageway, said control means being coupled to said latching mechanism for automatically closing said passageway when said hub is in a latched position in which said latching arms secure the cover to the rim and for automatically opening said passageway in other positions of said hub.

15. An improved plate-like hatch cover for closing a hatch opening of the type having a latching mechanism at one side of the cover, which includes a rotatable hub and plural latching arms extending in different directions from the hub towards a rim of the opening, said mechanism being operable such that rotation of said hub in one direction frees said latching arms from latching engagement with the rim while rotation of said hub in the opposite direction engages said latching arms with the rim, wherein the improvement comprises:

venting passageway defining means for defining a pressure relief passageway from one side of said cover to its opposite side;

control means for controlling the flow of fluids through said passageway, said venting passageway defining means comprising a hub rotating member for rotating said hub.

16. A plate-like hatch cover according to claim 15 in which said hub rotating member comprises a shaft extending centrally through said cover and at least partially through said hub, said shaft being axially slidable relative to said cover and hub and rotatable relative to said cover at least when in certain axial positions, said shaft defining said passageway such that said passageway communicates from one side of said cover to the other side when said shaft is in said certain axial positions, said control means comprising handle means affixed to an end portion of said shaft for axially moving the shaft to and from said certain positions.

17. A plate-like hatch cover according to claim 16 which includes O-ring sealing means between said shaft and the wall of the cover defining an opening through which the shaft extends, said shaft being of circular cross section except for a longitudinal bypass surface-defining section of reduced cross section, said bypass surface defining section beinhg positioned entirely at said one side of said cover when said shaft is in other than said certain positions and being positioned so as to extend past said O-ring sealing means and on both sides of said O-ring sealing means when said shaft is in said certain positions so as to provide said pressure relief passageway between said O-ring sealing means and said bypass surface defining section.

18. An improved plate-like hatch cover for closing a hatch opening of the type having latching means including a latching hub rotatable on one side of said cover and plural latching arms extending in different directions from said hub toward a rim of said hatch opening for latching said cover to said rim;

connecting means connecting said latching arms to said latching hub and to said cover to that said arms are moved into overlapping relation to said rim when said hub rotates to a limited extent in one direction and so that said arms are moved to clear said rim when said hub rotates to a limited extent in an opposite direction;

means for rotating said hub in opposite directions, camming surface means cooperative with said latching means in a manner such that rotation of said hub in said one direction to move said arms into overlapping relation to said rim also causes said arms to urge said cover into tight seated engagement with said rim when said hub is rotated to a latched position;

said means for rotating said hub including a shaft extending through a central opening in said cover and at least partially through a central opening in said hub, said shaft being axially slidable and rotatable relative to said cover and axially slidable relative to said hub;

handle means for rotating said shaft, said handle means being affixed to one end of said shaft on the side of said cover opposite said one side, said opposite side of said cover having a recessed surface portion for storing said handle means when not in use, said handle means being movable into said recessed portion by sliding said shaft axially through said cover and hub; and fluid sealing means between said shaft and the walls of said central cover opening for preventing leakage of fluid through said central cover opening between the opposite sides of said cover plate;

wherein the improvement comprises:

an elongated hub extension projecting outwardly away from said one side of said cover with at least a pair of longitudinal slots therein, said shaft including a lateral projection continuously and loosely received in each said slot in all axial positions of said shaft in which said handle is removed from said recessed surface portion such that rotation of said shaft correspondingly rotates said hub;

said latching arms being operable to secure said cover to said rim whenever said shaft is in an angular position such that said handle is axially slidable into said recessed surface portion, whereby with said handle positioned within said recessed surface portion a visual indication of the latched condition of the hub is provided; and said shaft including a longitudinal surface section of reduced cross section positioned entirely at said one side of said sealing means when said handle is in the recess, said surface section being positioned with a portion thereof on each side of said sealing means to provide a gap between said fluid sealing means and said surface section when said handle is outside of the recess and in position for rotating said shaft and hub, whereby a pressure-relieving passageway bypasses said sealing means whenever said handle is in position to rotate said hub.

19. A plate-like hatch cover for closing a hatch opening comprising:

a latching mechanism at one side of the cover including a rotatable hub and operable such that rotation of the hub in opposite directions through a limited arc respectively latches and unlatches the cover to and from a rim surrounding the opening;

a hub rotating member extending through said cover from said one side to the other side thereof, said hub rotating member being rotatable relative to said cover; and coupling means for operatively coupling said hub rotating member to said hub such that rotation of said hub rotating member rotates said hub to latch and unlatch the cover and such that said hub rotating member is in a predetermined angular position when said cover is latched so that angular positions of said hub rotating member relative to said cover indicate latched and unlatched conditions of said cover, handle means connected to an end portion of said hub rotating member on said other side of said cover for rotating said member, recessed surface means in said other side of said cover sized to receive said handle means flush with a major outer surface portion of said cover, said handle means being mounted on said hub rotating member for selective movement into said recessed surface means only when said hub rotating member is in said predetermined angular position, whereby the relative angular positions of said recessed surface means and said handle means provide indicator means for determining the latched and unlatched conditions of said cover.

* * * * *

UNITED STATES PATENT AND TRADEMARK OFFICE

CERTIFICATE OF CORRECTION

PATENT NO. : 4,273,064

DATED : June 16, 1981

INVENTOR(S) : Robert W. Sutton

It is certified that error appears in the above-identified patent and that said Letters Patent are hereby corrected as shown below:

Column 7, line 27, insert "such" between "hub" and "that";

Column 7, line 32, insert "hub rotating member at said" between "said" and "other";

Column 10, line 9, change "beinhg" to --being--;

Column 10, line 24, change "to" (second occurrence) to --so--;

Signed and Sealed this

*Twenty-second* Day of *September 1981*

[SEAL]

*Attest:*

GERALD J. MOSSINGHOFF

*Attesting Officer*

*Commissioner of Patents and Trademarks*